US006622643B1

(12) United States Patent
Velde

(10) Patent No.: US 6,622,643 B1
(45) Date of Patent: Sep. 23, 2003

(54) TABLE

(76) Inventor: Herleiv Velde, Underlia 154, N-3021 Drammen (NO)

( * ) Notice: Subject to any disclaimer, the term of this patent is extended or adjusted under 35 U.S.C. 154(b) by 0 days.

(21) Appl. No.: 10/019,216

(22) PCT Filed: Jun. 28, 2000

(86) PCT No.: PCT/NO00/00225

§ 371 (c)(1),
(2), (4) Date: Apr. 30, 2002

(87) PCT Pub. No.: WO01/01820

PCT Pub. Date: Jan. 11, 2001

(30) Foreign Application Priority Data

Jul. 2, 1999 (NO) ..... 19993308

(51) Int. Cl.[7] ..... A47B 57/00
(52) U.S. Cl. ..... 108/64
(58) Field of Search ..... 108/64, 65, 66, 108/69; D6/489, 480, 486, 483

(56) References Cited

U.S. PATENT DOCUMENTS

| | | | | | |
|---|---|---|---|---|---|
| 2,273,006 | A | * | 2/1942 | Carlson | 108/63 |
| 3,053,598 | A | | 9/1962 | Cheslow | |
| 4,732,088 | A | | 3/1988 | Koechlin et al. | |
| 4,878,439 | A | * | 11/1989 | Samson | 108/83 |
| 5,339,747 | A | | 8/1994 | Epps | |
| D355,547 | S | * | 2/1995 | Liston | D6/480 |
| D359,640 | S | * | 6/1995 | Newhouse et al. | D6/489 |
| 5,438,937 | A | | 8/1995 | Ball et al. | |
| 5,676,068 | A | | 10/1997 | Kallander | |
| D418,332 | S | * | 1/2000 | Tarlow | D6/483 |
| 6,363,866 | B1 | * | 4/2002 | Schwartz | 108/64 |

FOREIGN PATENT DOCUMENTS

| | | | | |
|---|---|---|---|---|
| DE | 197 15 184 A1 | | 10/1998 | |
| EP | 0 283 456 A1 | | 9/1988 | |
| EP | 0 648 450 A1 | | 4/1995 | |
| FR | 2544598 | * | 10/1984 | 108/64 |
| GB | 1 320 699 | | 6/1973 | |

OTHER PUBLICATIONS

1998 Price List "EFG möbler för kontor" from EFG Partner AB, Trehörnavägen, 2, Box 1017, S–573 28 Tranås, Sweden, See p. 35, Art. Nr. A38C86–A38H86, "Hörnbord för Inkopping Mellan TVÅ Bord".

* cited by examiner

*Primary Examiner*—Janet M. Wilkens
(74) *Attorney, Agent, or Firm*—Burns Doane Swecker & Mathis LLP

(57) ABSTRACT

A table (1) is described which comprises a tabletop (2) having a recess for providing a working area, the horizontal outline of the tabletop being partly coincident with an imaginary right-angled quadrilateral such as a rectangle or a square, wherein the tabletop (2) has two diagonally opposite, right-angled, equilateral, similarly shaped corner sections having sides of different lengths (A, C) which form a part of the sides of the quadrilateral, the rectilinear corner edges adjoining the edge portions which follow a curve or line that severs the diagonally opposite corner sections of the right-angled imaginary quadrilateral, in such manner that the imaginary corner sections form the recess (6). The use of the table in a table assembly is also described.

10 Claims, 2 Drawing Sheets

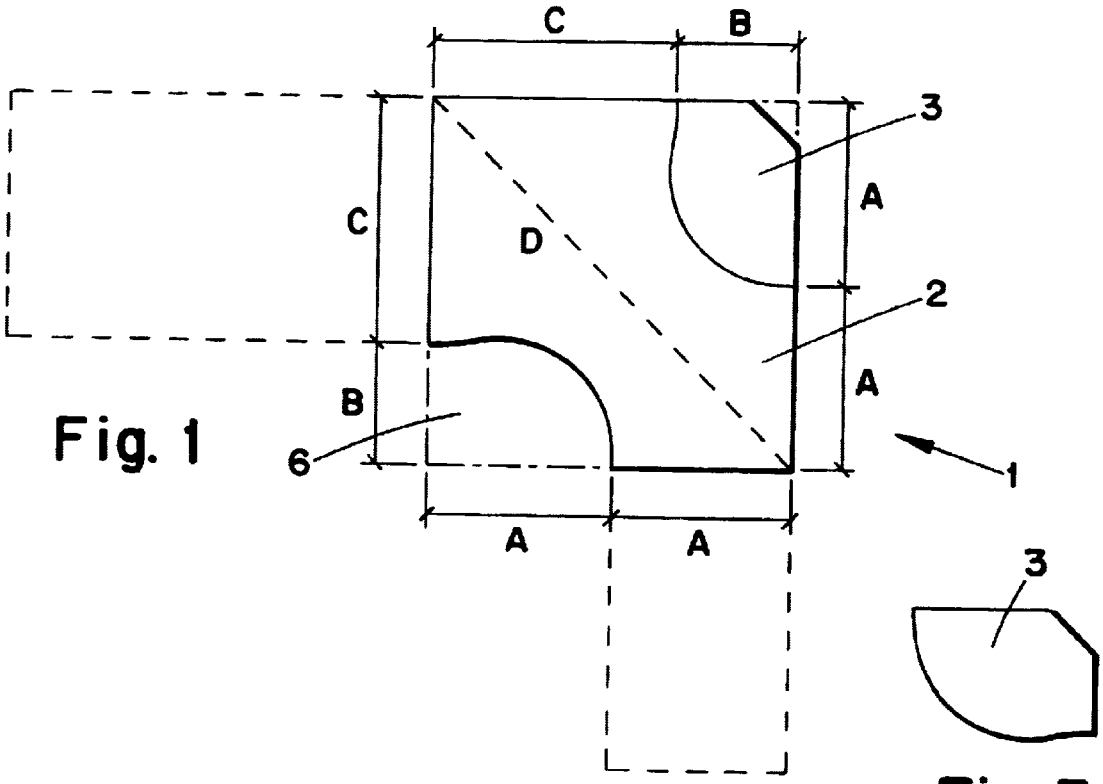
Fig. 1
Fig. 3
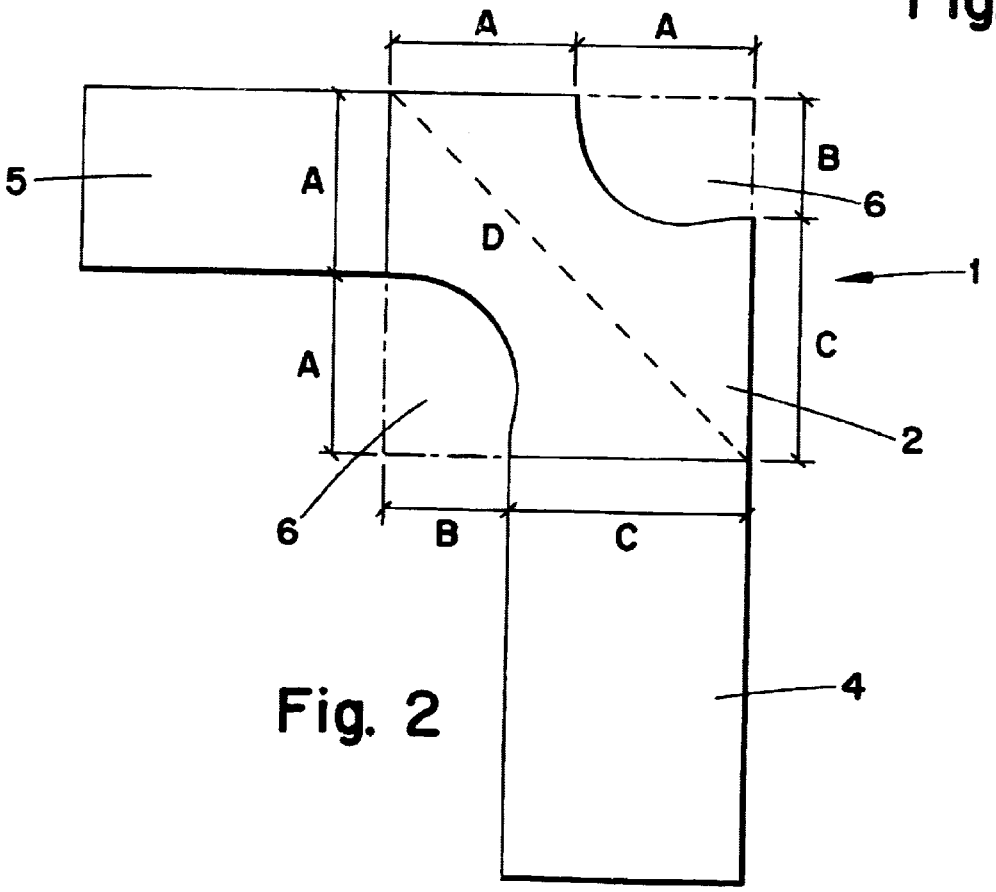
Fig. 2

TABLE

FIELD OF THE INVENTION

The present invention relates to a table having recesses for working areas, and to the use of the table in a table assembly.

BACKGROUND

Today's requirements with respect to an office workstation are influenced by the fact that the user should work in an ergonomically correct position and that at the same time the office furniture should be movable and adaptable, in many cases to other offices.

The ergonomic requirement has been met using corner tables which have the means for raising and lowering a computer screen, and by connecting the corner table to a main table having a depth of about 80 cm and a side table having a depth of about 40 to 60 cm. This ensures a large work surface, but not so large that the table cannot be placed in a two-module room (about 2.20 m×4 m). The corner table has been determining factor for the layout of the workstation and the user has had to choose whether the table assembly should have as its starting point a corner table in the right-hand or left-hand corner of the room. Consequently, the interconnected table assembly has not been adaptable to more than two of the room's four corners.

As an example of the prior art reference can be made to the price list of April 1999 from the Martelas furniture factory which includes a number of desk systems.

Insofar as corner tables are concerned, it is a common feature that the working area for, e.g., the use of a computer, is arranged in a recess or indentation in the tabletop. It is also a fact that all known corner tables are intended for either right-hand or left-hand assembly. This limitation to right-hand or left-hand assembly means that the user must make a choice, and this may often prove to be inappropriate should the need arise later to move the workstation.

A number of examples of table assemblies are known from the patent literature. In this connection, reference can be made to DE-A1 19715184, EP-A1 648450 and U.S. Pat. Nos. 3,053,598, 4,732,088, 5,339,747, 5,438,937 and 5,676,068. However, none of these documents teach a table solution of the corner type which affords the same flexibility as the subject matter of the application.

SUMMARY

Accordingly, the object of the invention is to provide a table of the type mentioned in the introductory paragraph, where far greater flexibility is attained in that the corner table can be used for both right-hand and left-hand assembly.

BRIEF DESCRIPTION OF THE DRAWINGS

The invention will now be described with reference to the drawings, wherein:

FIG. 1 is a schematic illustration of a table 1 positioned as a so-called right-hand solution i.e., with a corner table placed to the right of a main table;

FIG. 2 shows the table 1 positioned as a left-hand solution; and

FIG. 3 shows a tabletop section which has been cut out of the tabletop.

DETAILED DESCRIPTION OF EMBODIMENTS OF THE INVENTION

Figure 4:
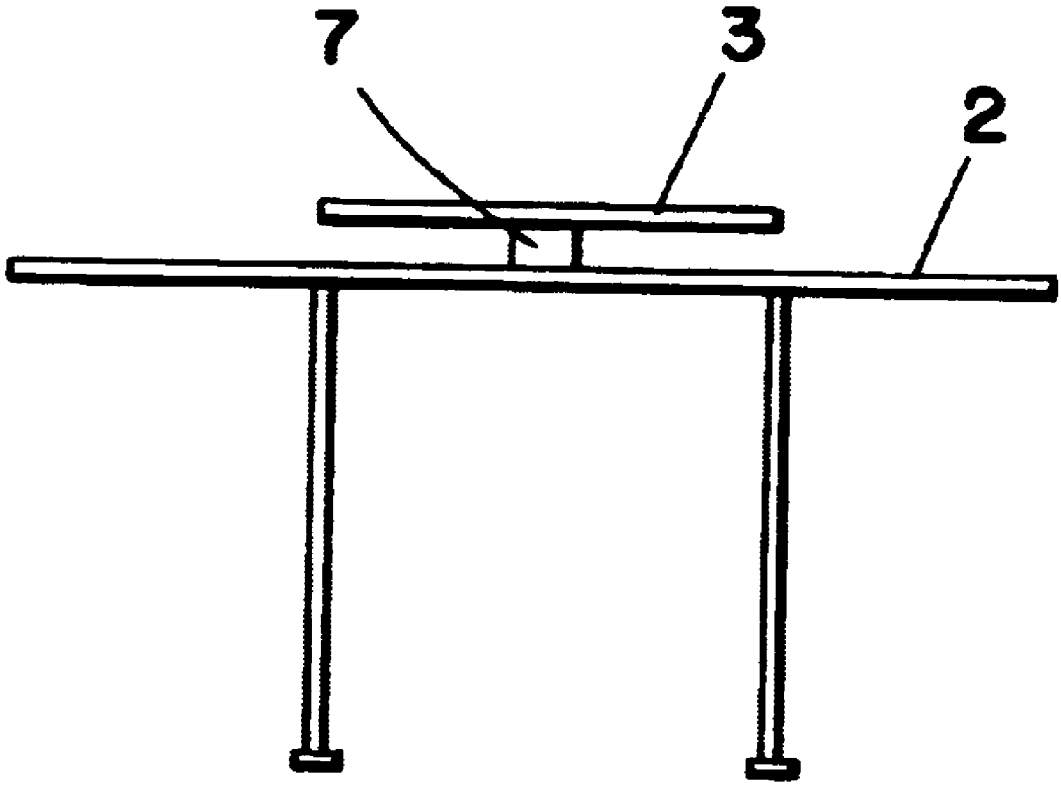
FIG. 4 shows a tabletop section with a raising and lowering mechanism.

The outline or boundary of a tabletop 2 and a tabletop section 3 is shown in bold lines. As a starting point for the tabletop 2, a square top is preferred. This is indicated by using stippled lines to show the cut-away parts on the figures. At the two opposite corners of the basic top two recesses 6 have been made, each of which can form the basis for tabletop sections 3. The tabletop section 3 can also be made in another way, the essential point being that it fits into the recess 6. As can be seen in the figures, the recesses 6 are identical, or almost identical, and symmetrical about a diagonal D extending between the other corners of the tabletop 2. In general, the shape of the tabletop 2 is best defined in that its horizontal outline is partly coincident with an imaginary right-angled quadrilateral such as a rectangle or square, it having two diagonally opposite, right-angled, equilateral, similarly shaped corner sections having sides of different lengths, A and C respectively, which form a part of the sides of the quadrilateral, the rectilinear corner edges adjoining the edge portions which follow a curve or a line that severs the diagonally opposite corner sections of the imaginary right-angled quadrilateral, in such manner that the imaginary corner sections form the recess 6.

In the illustrated example, the recess, which may be rectilinear, has been given a substantially curved shape which starts at about halfway along the side edge of the tabletop and ends preferably in a straightened part at the adjacent side edge. The recess is given a suitable depth, and could in fact also have been symmetrical. However, for ergonomic reasons, the illustrated shape has been found expedient. This is because the table must also be capable of being assembled with and optionally secured to side tables as indicated in broken lines at 4 and 5 in FIG. 2. Of the two side tables indicated, the largest side table 4 can be designated the main table and the smaller or second side table 5 an auxiliary table. However, these tables are not necessary even though they form a typical part of a corner solution. It is also possible to join the corner table to one or more similar corner tables, or the table may stand alone.

In the drawing the tabletop in FIG. 2 has been rotated 180° relative to the tabletop 2 in FIG. 1 to create the so-called left-hand solution. In order to fit in the tabletop section 3 from FIG. 1, this must then be rotated and turned so that its other surface faces upwards. It is therefore expedient that the tabletop section 3 should have been surface-treated, e.g., veneered or machine-finished, on both sides.

If the recess 6 and consequently the tabletop section 3 are made symmetrical about the diagonal between the corners of the imaginary corner sections, it is only necessary to surface treat one of the faces of the tabletop section.

The tabletop section 3 may be arranged so as to be capable of being raised and lowered, thus allowing, e.g., a computer screen to be placed in the optimal user position.

Such lowering and raising mechanisms 7 are well known in the technical field to which this application belongs and thus do not form a part of the present invention. The support structure or stand of the table 1 may be of steel or aluminum, or possibly of wood, and is as such known. Similarly, connectors that are known per se and preferably easy to mount are used. The table assembly thus can be adapted to the desired corner solution by means of one or two skillful movements and a simple tool such as a battery-operated drill.

The present invention provides a flexibility that is not found with any other corner table solution and allows an office workstation to be moved. It can be used in any office, primarily in company offices, but also in offices in the home or for other furnishing uses.

As the invention obviates the need to produce separate right-hand and left-hand tables, there is seen to be a considerable potential for savings where production costs are concerned, and not least where storage costs are concerned.

What is claimed is:

1. A table comprising a tabletop having recesses for forming working areas, the horizontal outline of the tabletop being partly coincident with an imaginary right-angled quadrilateral, the tabletop having two diagonally opposite, right-angled, similarly shaped corner sections, each of the corner sections having equilateral sides, said sides being different lengths for the two opposite corner sections, said sides forming part of the sides of the quadrilateral, each of the sides of the corner sections adjoining an edge portion which follows a curve or a line that severs the diagonally opposite corner section of the imaginary right-angled quadrilateral, forming recesses at imaginary corner sections of the quadrilateral, so that by rotating the tabletop by 180° in a horizontal plane, the tabletop can be arranged as a left-hand table or a right-hand table.

2. A table according to claim 1, wherein the recesses are symmetrical about a diagonal between the opposite corners of the tabletop.

3. A table according to claim 1, wherein the tabletop in the area for at least one of the recesses is equipped with a tabletop section having the shape of the one recess.

4. A table according to claim 3, wherein the tabletop section is surface-treated on both faces of the tabletop section so that each of the faces may form the surface of use of the tabletop section.

5. A table according to claim 4, wherein the tabletop section is cut off at a right-angled corner to provide space for electric leads and the tabletop section may be arranged so as to be adjustable with the aid of a raising and lowering mechanism.

6. A table according to claim 4, wherein the tabletop section is surface-treated in the same way as the surface of the tabletop.

7. A method of using a table according to claim 1 in a table assembly, comprising attaching at least one of the opposite and dimensionally different corner sections to at least one table having substantially the same attachment width as the corner edges of the tabletop, which at least one table is rectangular, or made with a tabletop having recesses for forming working areas.

8. A method of using a table according to claim 1 in a right-angled table assembly, comprising attaching the opposite corner sections of the tabletop to their respective rectangular tables having a width substantially equal to that of the respective corner edge.

9. A method of using a table according to claim 1 in a table assembly, comprising attaching the largest corner section of the tabletop to a rectangular table having substantially the same width as the corner edge of the tabletop.

10. A method of using a table according to claim 1 in a table assembly, comprising attaching the smallest corner section of the tabletop to a rectangular table having substantially the same width as the corner edge of the tabletop.

* * * * *